United States Patent [19]

Blessing

[11] 4,327,653

[45] May 4, 1982

[54] CONTINUOUS SEWER

[75] Inventor: Hubert Blessing, Dallas, Tex.

[73] Assignee: Levi Strauss & Co., San Francisco, Calif.

[21] Appl. No.: 113,813

[22] Filed: Jan. 21, 1980

[51] Int. Cl.[3] ..... D05B 3/00; D05B 27/00

[52] U.S. Cl. ..... 112/121.14; 112/304

[58] Field of Search ..... 112/121.14, 303, 304, 112/2

[56] References Cited

U.S. PATENT DOCUMENTS 2,836,133 5/1958 Gamble et al. ..... 112/121.14

2,855,877 10/1958 Whitehead ..... 112/121.14

3,496,891 2/1970 Kosrow et al. ..... 112/304 X

*Primary Examiner*—Peter P. Nerbun

*Attorney, Agent, or Firm*—Philip M. Shaw, Jr.

[57] ABSTRACT

In order to allow a sewing machine to continuously sew workpieces fed to it by a conveyor during periods when the conveyor is stopped for workpiece loading, drive means are provided for cyclically moving the sewing machine back and forth alongside the conveyor parallel to the direction of conveyor travel, while simultaneously driving the conveyor at twice the sewing machine's rate of travel when it moves in the direction of workpiece feed and for stopping the conveyor when the sewing machine is traveling in the opposite direction.

4 Claims, 4 Drawing Figures

CONTINUOUS SEWER

BACKGROUND OF THE INVENTION

1. Field of the Invention

This invention relates to automated sewing machines and means for feeding cloth or other workpieces through them. Previous inventions have addressed the problems of stitching or seaming pieces of cloth together, e.g., railway sewing machines. Unlike railway-type machines, wherein the machine is moved with respect to a stationary workpiece, or vice versa, the present invention must co-operate with a conveyor belt upon which the workpiece is loaded. The conveyor must be stopped and started at intervals to allow loading of the workpieces onto the belt.

2. Brief Description of the Prior Art

Previous patents embrace only the general problem of stitching or seaming workpieces together. In the present day automated garment manufacturing facilities there is a need for apparatus which has the capability of continuously sewing a conveyor carried workpiece at a constant stitch rate, even though the conveyor is intermittently stopped to load new workpieces on the conveyor. Prior art, railway type sewing machines do not lend themselves to solving this problem. As examples, both Gamble et al., U.S. Pat. No. 2,836,133, and Gentry et al., U.S. Pat. No. 2,724,352, comprehend railway-type sewing machines. Cloth workpieces are merely set in stationary frames and the sewing machines are moved relative to the workpiece on a railway. In Gentry, a variable speed drive attachment for altering the speed of the sewing machine is claimed. This attachment must be controlled by, one assumes, a skilled operator.

Whitehead, U.S. Pat. No. 2,855,877, shows a sewing machine mounted upon one stage which is itself mounted on a second stage. By utilizing a common driving mechanism, a continuous stitching pattern can be accomplished. The stitch pattern is altered by movement of the stages relative to each other.

All such railway type machines are too cumbersome to load and are sensitive to shapes and styles of workpieces and types of material. None of these references solves the problem of providing an automated, continuous sewing apparatus which allows intermittent loading of workpieces.

SUMMARY AND OBJECTS OF THE INVENTION

The present invention overcomes these problems and allows continuous sewing and intermittent workpiece loading. The apparatus of the invention comprises a sewing machine, a variable speed workpiece conveyor for serially feeding workpieces in a first direction, past the sewing machine as it sews them, means for reciprocating the sewing machine back and forth alongside the conveyor so that the sewing machine alternately travels in the same direction as the conveyor and then in the opposite direction, means for controlling the speed of the conveyor as a function of the sewing machine reciprocation means so that the conveyor is stationary when the sewing machine is moving in a direction opposite to the first direction and so that the conveyor travels at twice the speed of the sewing machine when it travels in the first direction, whereby the rate of movement of the sewing machine with respect to the workpiece remains constant while it is being sewn by the sewing machine.

In the preferred embodiment of the invention, two torque inputs are supplied. The first is a continuously running drive which also drives the sewing machine. The other torque input is a cyclically reversing drive which also reciprocates the sewing machine with respect to a conveyor by means, for example, of a rack and pinion. Both inputs also feed into a differential gear box. The resultant output of the differential gear box drives the conveyor carrying the workpiece to pass through the sewing machine. When the reversing drive rotates in the opposite direction as that of the continuously running drive, no output is supplied from the differential gear box, and the conveyor is stopped in relation to a fixed reference. The sewing machine continues in a path upstream with respect to the conveyor's normal direction of the workpiece feed. At this point, workpieces may be loaded, unloaded, or repositioned on the conveyor.

As the reversing drive begins to reverse its rotation, an output is produced from the differential gear box which is the additive sums of the two inputs. The conveyor travels thus in the workpiece feed direction. When the speed and direction of the reversing drive are the same as those of the continuously running drive, the speed of the conveyor as the differential output of the inputs, is twice the speed of travel of the sewing machine. In this way the speed of motion of the sewing machine relative to the workpiece remains constant for a uniform stitch rate. Also the pitch length of the workpieces on the conveyor can be easily varied by changing the number of revolutions of the reversing drive during each cycle.

Advantages over other machines are notable. This invention avoids the need to stop the machine manually in order to load, unload or reposition a new workpiece. Because the workpiece position and orientation relative to the sewing needle can be easily varied by varying the placement of the workpiece on the conveyor, the continuous sewer of the invention is able to sew workpieces of differing lengths and textures. Many prior art, railway machines required special workpiece holders which limited the ability of the machine to take workpieces of differing types.

It is thus an object of this invention to provide an efficient, economical means for automatically and continuously stitching or seaming conveyor fed workpieces while intermittently stopping the conveyor for loading, with a readily adjustable pitch length for the conveyor and sew lengths.

It is another object of the invention to provide a continuous seamer which is easily loaded.

It is a still further object of the invention to provide a continuous seamer which is not sensitive to the styles or lengths of workpieces.

DETAILED DESCRIPTION OF THE PREFERRED EMBODIMENTS

Figure 1:
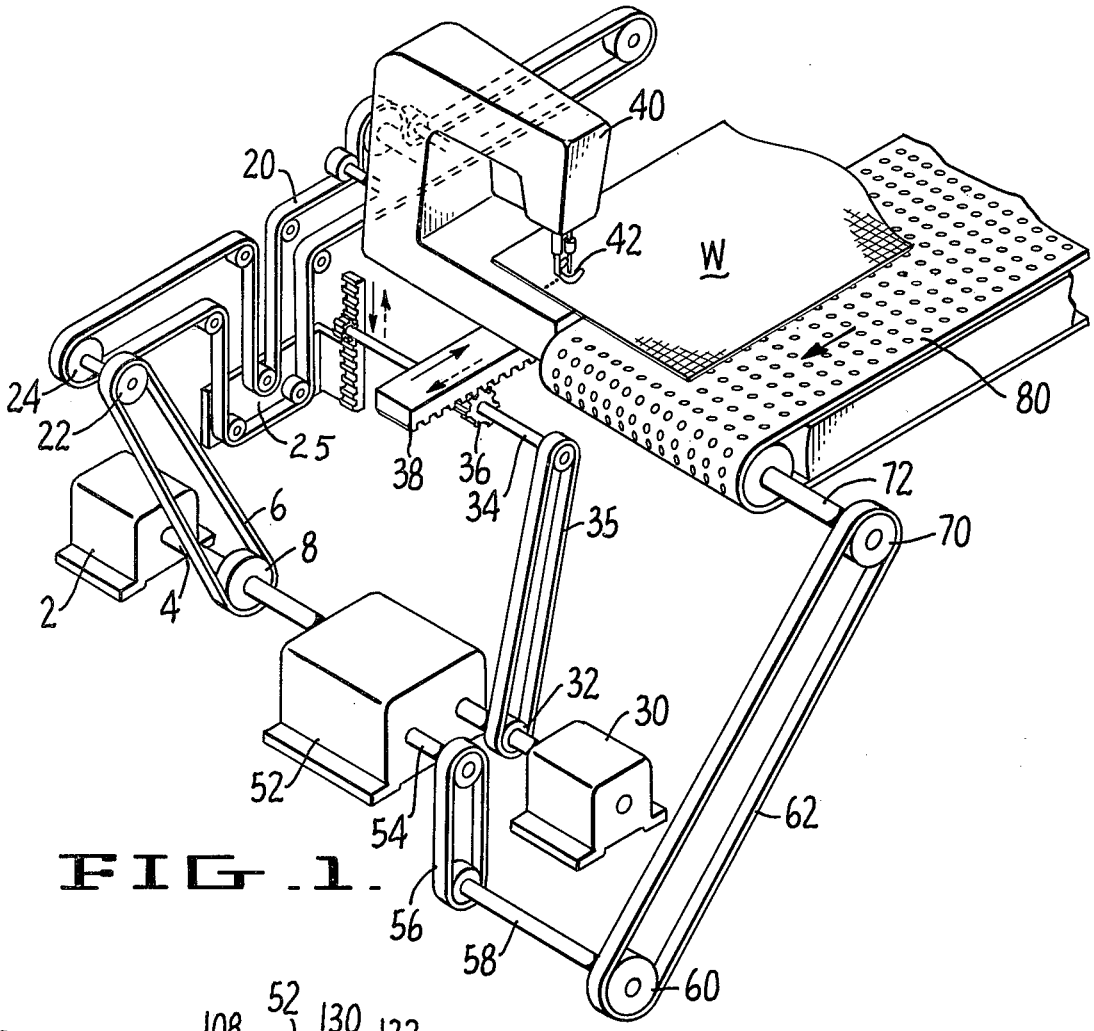
FIG. 1 is a front, perspective view partially in section of the invention.

Referring now to FIG. 1, the interaction between the various components of the invention are depicted. A continuously running motor 2 drives a shaft 4 which runs a sewing machine 40 via a series of belts 6 and 20 and pulleys, 8, 22, and 24. Simultaneously, the shaft 4 applies an input torque to one input of a differential gear box 52. A cyclically reversing motor 30 in turn, drives a shaft 32 connected by a belt 35 to a shaft 34 and a rack and pinion gear support 36, 38 for the sewing machine 40. This rack and pinion gear support reciprocates the sewing machine 40 back and forth alongside a vacuum conveyor belt 80 as the motor 30 cyclically reverses direction. The slack take-up arrangement of the series of belts 6 and 20 and pulleys 8, 22, 24 and 25 allows the sewing machine needle to be driven at a constant rate irrespective of movement of the sewing machine 40 relative to the conveyor 80. At the same time, reversing motor 30 also applies an input torque to a second input of the differential gear box 52 also via shaft 32.

The differential gear box 52, which in the course of this description, will be further detailed, produces an output equal to the additive sums of the inputs from the continuously running motor 2 and the reversing motor 30. This output torque is translated via shaft 54 and belt-pulley arrangement 56 to shaft 58 and by belt-pulley arrangement 60, 62 and 70 to a driving shaft 72 connected to move the vacuum conveyor belt 80. Conveyor belt 80 will carry and hold a workpiece W beneath the sewing needle 42 of the sewing machine 40 as the workpiece is sewn.

Figure 2:
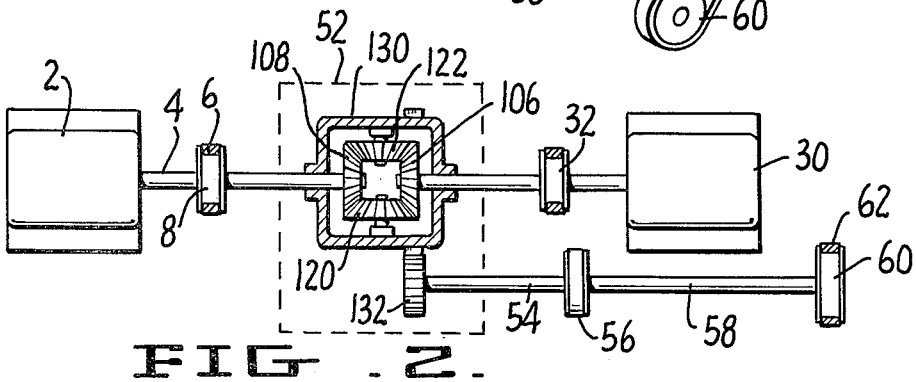
FIG. 2 is a side, elevational view partially in section of the invention.

As best depicted in FIG. 2, the differential gear box 52 comprises two bevel gears 106 and 108, which are driven by shafts 32 and 4, respectively, which are connected to the cyclically reversing motor 30 and the continuously running motor 2. Loosely mounted on the shafts 32 and 4 is a housing 130. Bolted or otherwise permanently affixed to the opposed, interior sidewalls of housing 130 are differential pinions 122 and 120. The exterior surface of the housing 130 itself acts as a gear, interfacing with drive gear 132 which, via shafts 54, 58, 72 and belt-pulley arrangements 56, 60, 62, 70 drives the conveyor belt 80.

Figure 3:
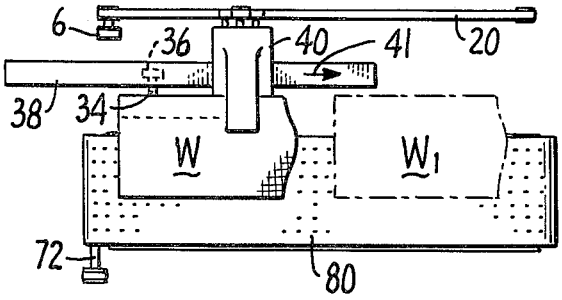
FIG. 3 is a top or plan view of the invention, with portions broken away.

When bevel gears 106 and 108 rotate in directions opposite to each other at the same speed, that is, when the motors 2 and 30 are applying torques at the same speed but in opposite rotational directions, differential pinions 122 and 120 also rotate in opposite directions. Since the torque supplied by these inputs is taken up by the differential pinions 122 and 120, the housing 130 remains motionless. Thus, no output is sent to the conveyor belt 80 and it stops. This is further illustrated in FIG. 3. The motor 30, however, causes the rack and pinion arrangement 36, 38 to move the sewing machine 40 in a direction, denoted by the arrow 41 in FIG. 3, opposite to the direction of workpiece feed.

Figure 4:
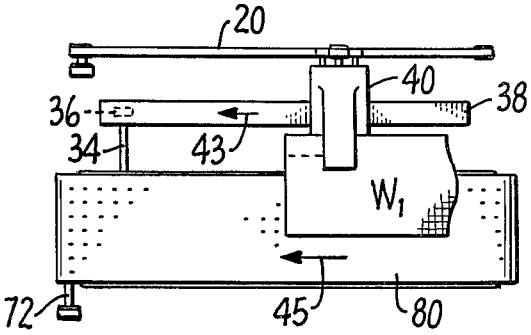
FIG. 4 is an additional top or plan view of the invention, with portions broken away.

As the reversing motor 30 begins to reverse the direction of rotation of the shaft 32, and thus, bevel gear 106, so that bevel gears 106 and 108 now rotate in the same direction, differential pinions 122 and 120 will cease rotating and begin to lock. As this occurs, the combined input torques from the bevel wheels 106 and 108 will create a new torque on the housing 130. This torque translates the sums of the rotary motions of bevel gears 106 and 108 to rotate drive gear 132. Drive gear 132 by means of belt pulley arrangements 56 and 62 drives the conveyor belt 80. The sewing machine 40 reverses its direction of travel becuase it is moved under the power of the motor 30. Conveyor belt 80 thus travels at a speed twice that of the sewing machine 40 mounted on toothed rack 38 and in the same direction, as denoted by the arrows 43, 45 illustrated in FIG. 4.

It can thus be seen that changing the number of revolutions of the reversing motor shaft 32 during each cycle will also change the workpiece pitch length on the conveyor 80 (assuming automatic loading at a fixed rate) and the sew length. This change can be effected by suitable variable gearing or by changing the nature of the electrical power (e.g. changing the frequency) to the motor 30.

This embodiment is illustrative only and not meant to restrict the invention to the present disclosure, since equivalents of the interworking parts are possible. For example, the differential gears, motors, and belt-pulley arrangements could be replaced in other embodiments by similarly interrelated servo-motors and gear drives. Also the torque inputs could be supplied by drive shafts extending from other, related machinery so that all such apparatus will operate in synchrony. Furthermore, other conveyors besides a vacuum conveyor belt are possible.

What is claimed is:

1. A continuous sewer comprising:

a. differential drive means having first and second torque inputs and a torque output, the torque output being the sums of the first and second torque inputs;

b. continuously running means supplying the first torque input;

c. cyclically reversing means supplying the second torque input;

d. continuously driven sewing machine;

e. a conveyor for carrying a workpiece past the sewing machine and which is cyclically driven by the output torque of the differential drive means; and f. sewing machine transport means driven by the cyclically reversing means for reciprocating the sewing machine alongside the conveyor.

2. A continuous sewer as recited in claim 1 wherein:

a. the continuously running means is a continuously running motor running at a constant, predetermined speed;

b. the cyclically reversing means is a motor which cyclically reverses itself over a predetermined period;

c. the sewing machine is driven by the first input; and d. wherein the reversing motor, after matching the direction and speed of the rotation of the continuously running motor, reverses its rotation with respect to the continuously running motor until both motors rotate at the same speed in opposite directions.

3. The continuous sewer of claim 1 wherein the sewing machine transport means is a rack and pinion assembly.

4. The continuous sewer of claim 1 wherein the conveyor includes a vacuum conveyor belt.

* * * * *